US009358792B2

(12) United States Patent
Fukuda

(10) Patent No.: US 9,358,792 B2
(45) Date of Patent: Jun. 7, 2016

(54) LIQUID EJECTING APPARATUS, AND METHOD FOR CONTROLLING LIQUID EJECTING APPARATUS

(71) Applicant: SEIKO EPSON CORPORATION, Tokyo (JP)

(72) Inventor: Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/612,122

(22) Filed: Feb. 2, 2015

(65) Prior Publication Data

US 2015/0217565 A1 Aug. 6, 2015

(30) Foreign Application Priority Data

Feb. 4, 2014 (JP) ..... 2014-019680

(51) Int. Cl.
*B41J 2/165* (2006.01)
*B41J 2/045* (2006.01)

(52) U.S. Cl.
CPC ..... *B41J 2/16526* (2013.01); *B41J 2/04513* (2013.01); *B41J 2/04536* (2013.01); *B41J 2/04581* (2013.01); *B41J 2/16508* (2013.01)

(58) Field of Classification Search
CPC ..... B41J 2002/0055; B41J 2/04501; B41J 2/04536; B41J 2/04581; B41J 2/16526
See application file for complete search history.

(56) References Cited

U.S. PATENT DOCUMENTS

2002/0186278 A1* 12/2002 Nakamura et al. ..... 347/46
2004/0145622 A1* 7/2004 Suzuki ..... 347/27
2005/0073548 A1 4/2005 Suzuki
2005/0212851 A1* 9/2005 Akase et al. ..... 347/40
2011/0109676 A1* 5/2011 Tsubota et al. ..... 347/11

FOREIGN PATENT DOCUMENTS

JP 09-150506 6/1997
JP 2004-066677 3/2004

* cited by examiner

*Primary Examiner* — Kristal Feggins
*Assistant Examiner* — Kendrick Liu
(74) *Attorney, Agent, or Firm* — Workman Nydegger

(57) ABSTRACT

A first flushing pulse is a drive waveform for ejecting ink by displacing a meniscus onto a pressure chamber side and an ejecting side while interposing a standby position from the standby position, a second flushing pulse is a drive waveform for ejecting the ink by pushing out the meniscus onto the ejecting side, without substantially displacing the meniscus onto the pressure chamber side from the standby position, and in a flushing processing, after a first flushing processing is performed by ejecting the ink one or more times in accordance with the first flushing pulse, a second flushing processing is performed by ejecting the ink a plurality of times in accordance with the second flushing pulse.

4 Claims, 8 Drawing Sheets

LIQUID EJECTING APPARATUS, AND METHOD FOR CONTROLLING LIQUID EJECTING APPARATUS

The entire disclosure of Japanese Patent Application No: 2014-019680, filed Feb. 4, 2014 is expressly incorporated by reference herein in its entirety.

BACKGROUND

1. Technical Field

The present invention relates to a liquid ejecting apparatus such as an ink jet type recording apparatus, and a method for controlling thereof, and in particular, to a liquid ejecting apparatus that performs a maintenance processing for recovering ejecting ability of a liquid ejecting head by ejecting liquid from a nozzle, and a method for controlling a liquid ejecting apparatus.

2. Related Art

A liquid ejecting apparatus is an apparatus that includes a liquid ejecting head, and ejects (discharges) various kinds of liquid from the liquid ejecting head. For example, as the liquid ejecting apparatus, there is an image recording apparatus such as an ink jet type printer and an ink jet type plotter, but recently, the liquid ejecting apparatus is also applied to various kinds of manufacturing apparatuses by making use of a feature which is capable of precisely landing a very small amount of the liquid in a predetermined position. For example, the liquid ejecting apparatus is applied to a display manufacturing apparatus that manufactures a color filters of a liquid crystal display or the like, an electrode forming apparatus that forms an electrode of an organic electro luminescence (EL) display, a field emission display (FED) or the like, and a chip manufacturing apparatus that manufactures a biochip (biological chemistry element). Therefore, in a recording head for the image recording apparatus, ink is ejected in a liquid shape, and in a color material ejecting head for the display manufacturing apparatus, a solution of each color material of R (Red), G (Green), and B (Blue), is ejected. Moreover, in an electrode material ejecting head for the electrode forming apparatus, an electrode material is ejected in a liquid shape, and in a bio-organic matter ejecting head for the chip manufacturing apparatus, a solution of the bio-organic matter is ejected.

Here, in the liquid ejecting apparatus described above, the liquid within the head is thickened by evaporating a solvent through a surface (meniscus) of the ink which is exposed at the nozzle of the liquid ejecting head. Accordingly, there are circumstances where a ejecting failure of not ejecting the liquid from the nozzle, or wherein a flight direction of the liquid which is ejected from the nozzle is bent. Hence, in the liquid ejecting apparatus of the kind described above, in order to suppress the ejecting failure, maintenance processing is performed for forcibly ejecting the liquid from the nozzle which is referred to as flushing, is performed, which is distinct from an ejecting processing of the liquid with respect to a landing target such as a recording medium or the like. Specifically, for example, whenever a fixed time is elapsed or whenever a pass (scan unit of the liquid ejecting head) is performed a predetermined times in the ejecting processing, a recording head is transferred up to an ink receiving member which is in the position out of the recording medium, so that droplets are repeatedly ejected from a nozzle into the position thereof (for example, JP-A-2004-066677).

In the flushing described above, a drive waveform (drive pulse) (which is used in a liquid ejecting processing with respect to the landing target such as the recording medium or the like), or a drive waveform only for the flushing, is used. Therefore, a pressure generation unit is driven by applying the drive waveform to the pressure generation unit, and thereby, a pressure variation is generated to the liquid within a pressure chamber to communicate with the nozzle. Accordingly, the liquid is ejected (made to be shot) from the nozzle using the pressure variation. At this time, in general, after the meniscus within the nozzle is pulled into the pressure chamber side once by firstly decompressing the inside of the pressure chamber, the meniscus is pushed out onto an opposite side (ejecting side) to the pressure chamber side by rapidly pressurizing the inside of the pressure chamber, and the droplets are ejected from the nozzle. By continuously repeating such operations the predetermined times, the liquid which is thickened within the nozzle and the pressure chamber, is discharged.

Moreover, the case of performing the flushing by a so-called push shooting manner, is proposed (for example, see JP-A-09-150506). That is, by pressurizing the inside of the pressure chamber without first performing the decompression of the pressure chamber, the meniscus within the nozzle is pushed out onto the opposite side (ejecting side) to the pressure chamber side from an initial position, and the droplets are ejected from the nozzle.

In a configuration of ejecting the liquid by using a reaction after pulling the meniscus into the pressure chamber side in the flushing as described in JP-A-2004-066677, it is possible to eject a lot of liquid at one time, and to efficiently discharge the thickened liquid in the vicinity of the nozzle. On the other hand, when degrees of thickening are relatively slight, there is a problem of wasting the liquid by consuming the liquid more than necessary. Additionally, when the inside of the pressure chamber is decompressed in order to pull the meniscus into the pressure chamber side, the thickened liquid in the vicinity of the nozzle is diffused to the pressure chamber side, and there is the problem of generating the necessity to discharge rather more liquid in order to discharge the thickened liquid which is diffused. On the other hand, in the configuration of ejecting the droplets from the nozzle by the so-called push shooting manner as described in JP-A-09-150506, since force for stirring the liquid is weak in comparison with the former configuration, when the thickening of the liquid relatively proceeds, there is a problem of being difficult to eject the liquid without being capable of diffusing the thickened liquid in the vicinity of the nozzle. Hereby, in order to discharge the thickened liquid, the flushing ought to be performed more times, and as a result, it is likely to consume a lot of liquid.

SUMMARY

An advantage of some aspects of the invention is to provide a liquid ejecting apparatus that is capable of reducing wasted consumption in liquid at a flushing processing, and a method for controlling a liquid ejecting apparatus.

According to an aspect of the invention, there is provided a liquid ejecting apparatus including a liquid ejecting head that has a pressure chamber to communicate with a nozzle, and a pressure generation unit to generate a pressure variation to liquid within the pressure chamber, and is capable of ejecting the liquid from the nozzle by an operation of the pressure generation unit. The apparatus is configured to be capable of performing a flushing processing by driving the pressure generation unit by a first drive waveform, and a second drive waveform which is different from the first drive waveform. The first drive waveform is a drive waveform for ejecting the liquid from the nozzle by displacing a meniscus at the nozzle, along a nozzle axis direction onto the pressure chamber side and an ejecting side which is opposite to the pressure chamber side while interposing a standby position from the standby position. The second drive waveform is a drive waveform for ejecting the liquid from the nozzle by pushing out the meniscus onto the ejecting side, without substantially displacing the meniscus at the nozzle onto the pressure chamber side from the standby position. In the flushing processing, after a first flushing processing is performed by applying the first drive waveform one or more times with respect to the pressure generation unit, a second flushing processing is performed by applying the second drive waveform a plurality of times with respect to the pressure generation unit.

In this case, it is possible to suppress the wasted consumption in the liquid, and to perform the efficient flushing processing. That is, by previously performing the first flushing processing using the first drive waveform in which an ejecting amount per one time is relatively large, it is possible to discharge the thickened liquid by softening or breaking the thickened liquid in the vicinity of the nozzle. Thereafter, by performing the second flushing processing using the second drive waveform in which the ejecting amount per one time is relatively small, and which is unlikely to stir the liquid in the vicinity of the nozzle, it is suppressed that the thickened liquid in the vicinity of the nozzle is diffused to the pressure chamber side, and it is possible to reduce the amount of the liquid which is consumed in the entire flushing processing.

In the liquid ejecting apparatus, it is preferable that depending on elapsed time from the time of finally ejecting the liquid, whether or not to perform the first flushing processing before the second flushing processing, is selected.

Moreover, in the liquid ejecting apparatus, it is preferable that when the elapsed time is a first time which is longer than a determination time Ts to be determined in advance, the first flushing processing is executed before the second flushing processing, and when the elapsed time is a second time which is shorter than the determination time Ts, only the second flushing processing is executed without executing the first flushing processing.

In this case, when the elapsed time is the first time which is longer than the determination time Ts, since the thickening of the meniscus relatively proceeds, by executing the first flushing processing before the second flushing processing, it is possible to discharge the thickened liquid more reliably. On the other hand, when the elapsed time is the second time which is shorter than the determination time Ts, since the thickening of the meniscus is relatively slight, by executing only the second flushing processing without executing the first flushing processing, it is suppressed that the unnecessary flushing is performed. As a result, it is possible to further reduce the amount of the liquid which is consumed in the entire flushing processing.

In the liquid ejecting apparatus, it is preferable that the determination time Ts is determined depending on viscosity change properties of the liquid.

In this case, since the determination time Ts is determined depending on the viscosity change properties of the liquid, it is possible to set the determination time Ts more appropriately, and it is possible to more reliably reduce the wasted consumption in the liquid at the flushing processing.

According to another aspect of the invention, there is provided a method for controlling a liquid ejecting apparatus including a liquid ejecting head that has a pressure chamber to communicate with a nozzle, and a pressure generation unit to generate a pressure variation to liquid within the pressure chamber, and is capable of ejecting the liquid from the nozzle by an operation of the pressure generation unit, the method including performing a flushing processing by driving the pressure generation unit by a first drive waveform, and a second drive waveform which is different from the first drive waveform. The first drive waveform is a drive waveform for ejecting the liquid from the nozzle by displacing a meniscus at the nozzle, along a nozzle axis direction onto the pressure chamber side and an ejecting side which is opposite to the pressure chamber side while interposing a standby position from the standby position. The second drive waveform is a drive waveform for ejecting the liquid from the nozzle by pushing out the meniscus onto the ejecting side, without substantially displacing the meniscus at the nozzle onto the pressure chamber side from the standby position. In the flushing processing, after a first flushing processing is performed by applying the first drive waveform one or more times with respect to the pressure generation unit, a second flushing processing is performed by applying the second drive waveform a plurality of times with respect to the pressure generation unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments for carrying out the invention, will be described with reference to the accompanying drawings. Furthermore, the embodiments described below, are variously limited as a suitable concrete example of the invention, but, unless the gist for particularly limiting the invention is written in the following description, the scope of the invention is not limited to the embodiments. Moreover, in the following, as a liquid ejecting apparatus of the invention, it will be described by using an ink jet type recording apparatus (hereinafter, printer) as an example.

Figure 1:
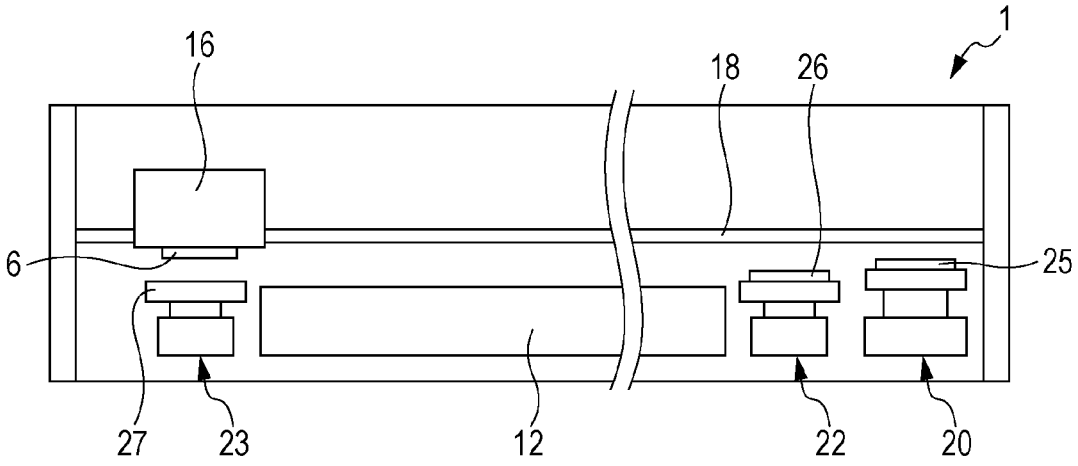
FIG. 1 is a front view of an inner configuration of a printer.
Figure 2:
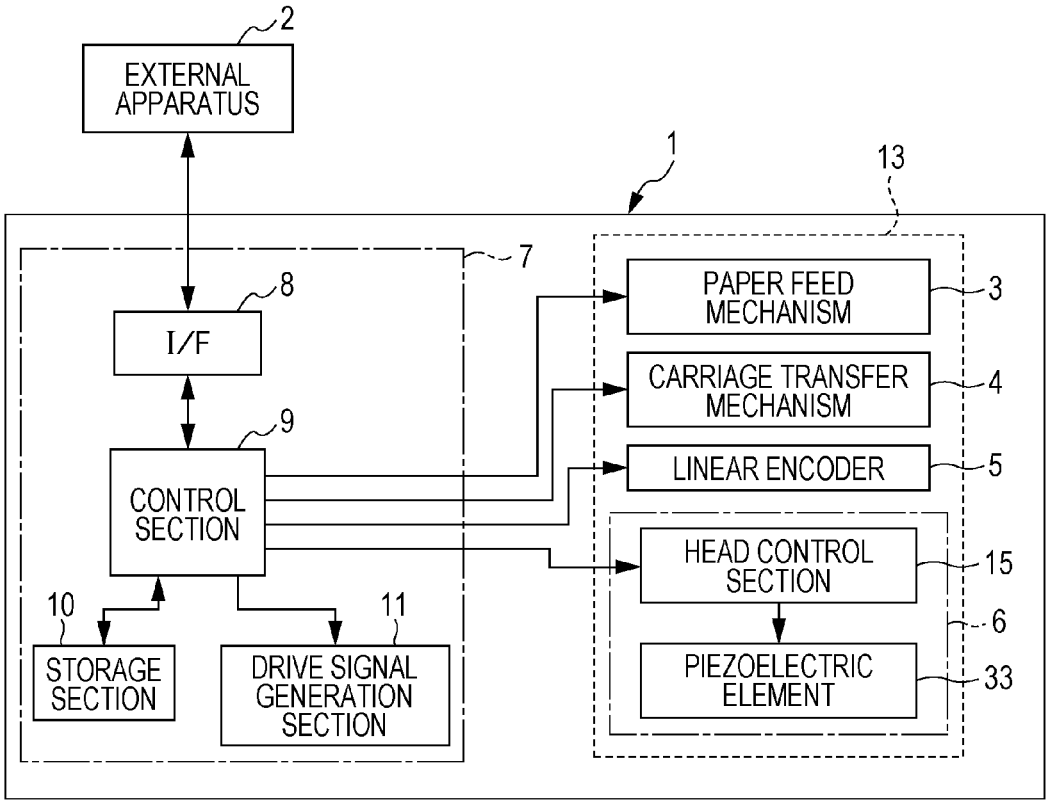
FIG. 2 is a block diagram of an electrical configuration of the printer.

FIG. 1 is a front view describing an inner configuration of a printer 1, and FIG. 2 is a block diagram describing an electrical configuration of the printer 1.

For example, an external apparatus 2 is an electronic device such as a computer, a digital camera, and a mobile phone. The external apparatus 2 is electrically connected to the printer 1 wirelessly or in a wired manner, and in order to print an image or a text on a recording medium (landing target of liquid) such as a recording sheet in the printer 1, the external apparatus 2 transmits printing data to the printer 1, depending on the image or the like.

The printer 1 of the embodiment has a printer controller 7 and a print engine 13. A recording head 6 (which is a kind of a liquid ejecting head) is attached onto a bottom face side of a carriage 16 mounting an ink cartridge (liquid supply source) 17 thereon. Therefore, the carriage 16 is configured to be reciprocally transferable along a guide rod 18 by a carriage transfer mechanism 4. That is, the printer 1 sequentially transports the recording medium onto a platen 12 by a paper feed mechanism 3, and ejects the ink which is a kind of the liquid in the invention from a nozzle 37 (see FIG. 3) of the recording head 6 while relatively transferring the recording head 6 in a width direction (main scan direction) of the recording medium, and records the image or the like by landing the ink onto the recording medium. Furthermore, it is possible to adopt the configuration in which the ink cartridge 17 is positioned on a main body side of the printer 1, and the ink of the ink cartridge 17 is transmitted onto the recording head 6 side through a supply tube.

At the position which is out of one end side (right side of FIG. 1) in the main scan direction with respect to the platen 12, a home position that is a standby position of the recording head 6, is set. At the home position, a capping mechanism 20 (capping unit), and a wiping mechanism (wiping unit) are sequentially arranged from one end side. Moreover, on the other end side (left side of FIG. 1) in the main scan direction interposing the platen 12 between the other end side and the home position, a flushing box 23 is arranged as a flushing domain. For example, the capping mechanism 20 has a cap 25 which is made up of an elastic member such as elastomer, and the cap 25 is configured to be convertible in a state (capping state) of being sealed by abutting the cap 25 onto a nozzle face (nozzle plate 31) of the recording head 6, or in an evacuation state of being separated from the nozzle face.

The wiping mechanism 22 has a wiper 26 that is capable of being transferred along a direction (nozzle line direction or subsidiary scan direction) intersecting with respect to the main scan direction, and the wiper 26 is configured to be convertible in the state of being abutted onto the nozzle face of the recording head 6, or in the evacuation state of being separated from the nozzle face. The wiper 26 can adopt various configurations, and for example, the wiper 26 is made up of a blade having elasticity whose a surface of a main body is covered with a cloth. The wiping mechanism 22 sweeps the nozzle face with the wiper 26 in the state of being abutted onto the nozzle face, by sliding the wiper 26 toward the other side from one side of the nozzle line. The flushing box 23 has an ink receiving section 27 in a tray shape that receives the ejected ink at the time of the flushing processing in which the ink is forcibly ejected from the nozzle of the recording head 6 regardless of a recording processing with respect to the recording medium. The position of the ink receiving section 27 is fixed.

The printer controller 7 is a control unit that performs control of each section of the printer 1. The printer controller 7 of the embodiment has an interface (I/F) section 8, a control section 9, a storage section 10, and a drive signal generation unit 11. The interface section 8 transmits the printing data or a printing command to the printer 1 from the external apparatus 2, or performs transmission and reception of state data of the printer 1 at the time of outputting state information of the printer 1 to the external apparatus 2 side. The control section 9 is an arithmetic processing apparatus for performing the control of the entire printer. The storage section 10 is an element that stores the data which is used in programs and various control of the control section 9, and includes a ROM, a RAM, and an NVRAM (non-volatile memory element). The control section 9 controls each unit in accordance with the programs which are stored in the storage section 10. Moreover, the control section 9 of the embodiment generates ejecting data showing whether the ink is ejected at which timing from which of the nozzles 37 at the time of the recording processing, on the basis of the printing data from the external apparatus 2, and transmits the ejecting data to a head control section 15 of the recording head 6. Furthermore, the control section 9 of the embodiment functions as a control unit that performs the flushing processing which is a kind of a maintenance processing. The details relating to the point, will be described later.

The drive signal generation section 11 (drive waveform generation unit), generates a drive signal (including a drive pulse) for recording the image or the like by ejecting the ink with respect to the recording medium. Moreover, the drive signal generation section 11 of the embodiment is configured to be capable of generating the plurality of drive signals for maintenance (drive signals COM1 and COM2 for flushing) including a maintenance drive waveform (flushing pulse FP). The details of the flushing processing using the drive signal for flushing, will be described later.

Next, the print engine 13 will described. As shown in FIG. 2, the print engine 13 includes the paper feed mechanism 3, the carriage transfer mechanism 4, a linear encoder 5, the recording head 6 and the like. The carriage transfer mechanism 4 is made up of the carriage 16 to which the recording head 6 is attached, and a drive motor (for example, DC motor) that makes the carriage 16 run through a timing belt or the like (not shown), and transfers the recording head 6 which is mounted on the carriage 16, in the main scan direction. The paper feed mechanism 3 is made up of a paper feed motor and a paper feed roller (both are not shown), and performs the subsidiary scan by sequentially sending out the recording medium onto the platen 12. Moreover, the linear encoder 5 outputs an encoder pulse as position information in the main scan direction, to the printer controller 7, depending on the scan position of the recording head 6 which is mounted on the carriage 16. The printer controller 7 can grasp the scan position (current position) of the recording head 6, on the basis of the encoder pulse which is received from the linear encoder 5 side.

Figure 3:
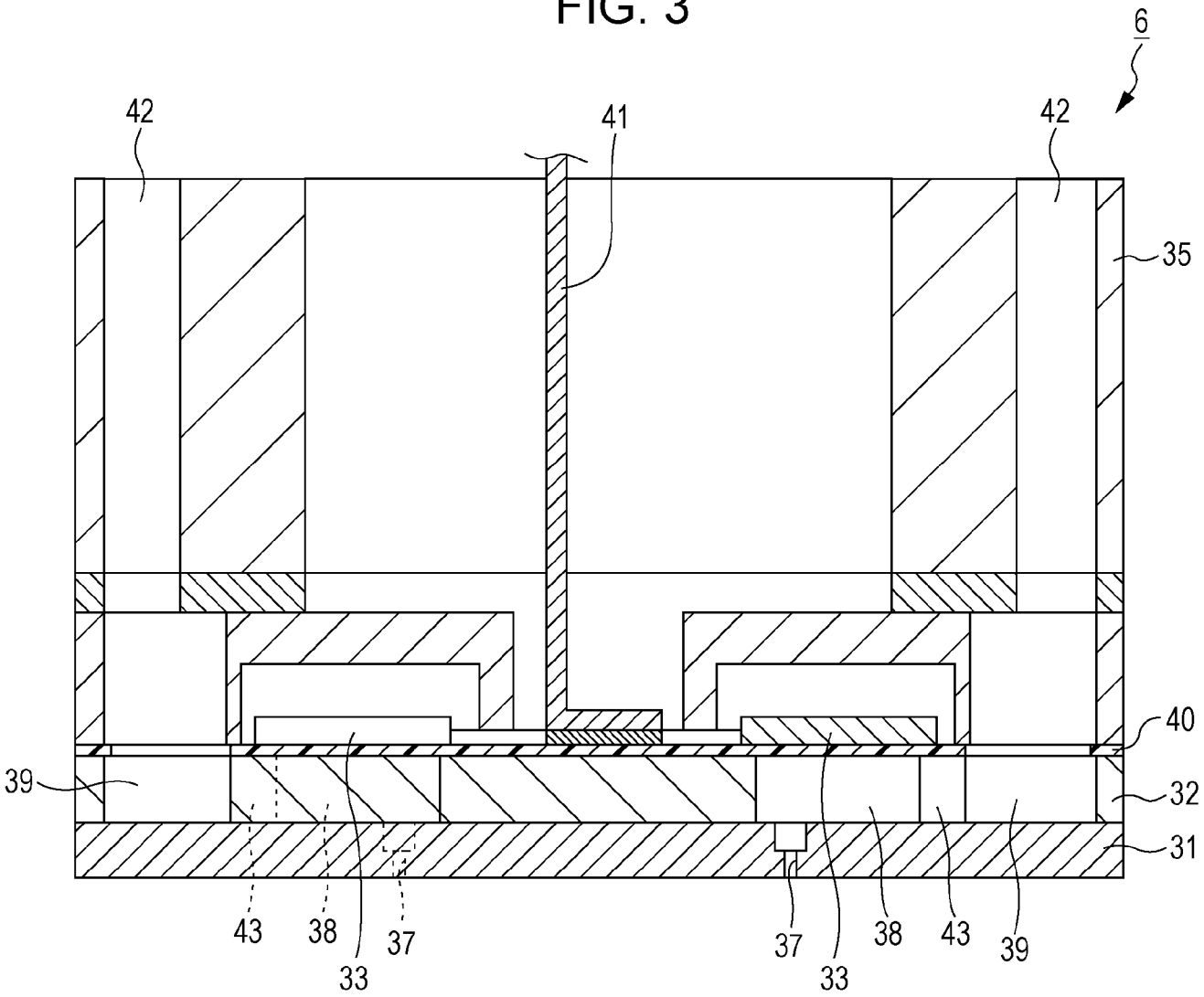
FIG. 3 is a cross-sectional view of an inner configuration of a recording head.

FIG. 3 is a cross-sectional view of a main portion describing an inner configuration of the recording head 6. The recording head 6 of the embodiment is schematically configured of the nozzle plate 31, a flow channel substrate 32, and a piezoelectric element 33, and is attached to a case 35 in the state of laminating the members. The nozzle plate 31 is a plate-shaped member where the plurality of nozzles 37 are arranged in a line shape along the same direction with pitch, corresponding to dot formation density. In the embodiment, the nozzle line (a kind of nozzle group) which is configured from the plurality of juxtaposed nozzles 37, is juxtaposed in two lines on the nozzle plate 31. Therefore, the face of the side on which the ink is ejected in the nozzle plate 31, corresponds to the nozzle face.

The flow channel substrates 32 is formed with a plurality of pressure chambers 38 which is divided by a plurality of partition walls and corresponds to each nozzle 37. On the outside of the line of the pressure chamber 38 in the flow channel substrate 32, a common liquid chamber 39 is formed in which a portion of the common liquid chamber 39 is divided. The common liquid chamber 39 is individually communicated with each pressure chamber 38, through an ink supply port 43. Moreover, in the common liquid chamber 39, the ink from the ink cartridge 17 side is introduced through an ink introduction path 42 of the case 35. On an upper face of an opposite side to the nozzle plate 31 side of the flow channel substrate 32, the piezoelectric element 33 is formed (a kind of the pressure generation unit) through an elastic film 40. The piezoelectric element 33 is formed by sequentially laminating a lower electrode film which is made of metal, a piezoelectric material layer which is made up of, for example, lead zirconate titanate, and an upper electrode film which is made up of metal (all are not shown). The piezoelectric element 33 is a piezoelectric element of a so-called bend mode, and is formed so as to cover an upper portion of the pressure chamber 38. In the embodiment, piezoelectric element lines of two lines corresponding to the nozzle lines of two lines, are juxtaposed in a direction which is perpendicular to the nozzle line in the state of alternating the piezoelectric element 33 therewith when viewed in the nozzle line direction. Each piezoelectric element 33 is modified by applying the drive signal through a wiring member 41. Hereby, a pressure variation is generated to the ink within the pressure chamber 38 corresponding to the piezoelectric element 33, and the ink is ejected from the nozzle 37 by controlling the pressure variation in the ink.

Figure 4:
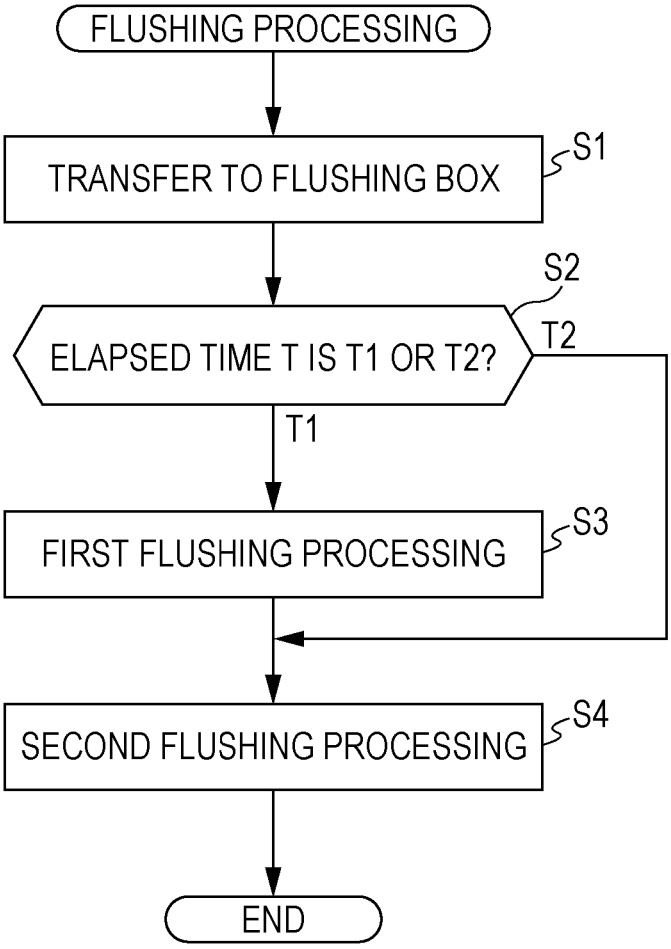
FIG. 4 is a flowchart of a flow of a flushing processing.

FIG. 4 is a flowchart describing a flow of the flushing processing which is executed in the printer 1. The flushing processing is periodically performed when the state of releasing the capping with respect to the nozzle face of the recording head 6 continues (such as the case where the recording head 6 is in the middle of executing the recording processing with respect to a recording medium S. Specifically, the flushing processing is a processing for discharging the thickened ink of an inner portion of the recording head 6 by forcibly ejecting the ink from the nozzle 37 at predetermined times. Moreover, there is the case of performing the flushing processing before the recording processing from charging a power source of the printer 1. If the time of the flushing processing arrives, first, the control section 9 controls the carriage transfer mechanism 4, and transfers the carriage 16 up to an upper side of the flushing box 23 (step S1). Next, an elapsed time T (time during which the ink is not ejected) until the present time from the time of finally performing the ejecting of the ink, is compared with a determination time Ts which is determined in advance (step S2).

Figure 5:
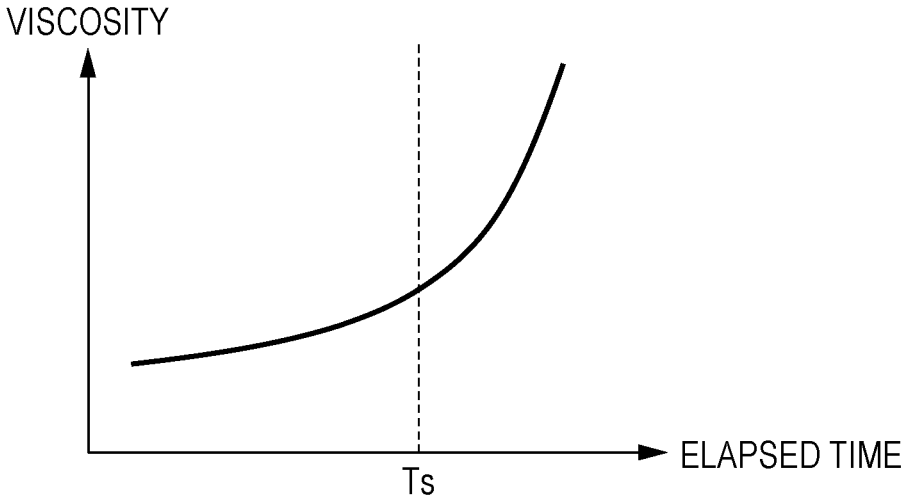
FIG. 5 is a graph illustrating a viscosity change (viscosity properties) of ink in the vicinity of a nozzle with respect to elapsed time.

FIG. 5 is a graph illustrating a viscosity change (viscosity properties) of the ink in the vicinity of the nozzle 37 of the recording head 6 with respect to elapsed time T. As shown in the same drawing, the viscosity of the ink increases as the elapsed time T increases, and after a fixed time has elapsed, the viscosity of the ink tends to increase rapidly. Hence, in the printer 1 of the embodiment, the time in the vicinity where the ink viscosity begins to increase rapidly, is determined as a determination time Ts. The viscosity properties of the ink varies by compositions of the ink. Thus, the determination time Ts is determined depending on the viscosity properties of the ink. For example, in the case where a pigment ink whose surface tension is from 25 [mN/m] to 35 [mN/m], is referred to as a super-permeability ink, the determination time Ts is set to 20 seconds.

Therefore, the printer 1 according to the invention, selects whether or not to perform a first flushing processing (described later) before a second flushing processing (described later), depending on the elapsed time T. That is, when the elapsed time T is determined to be a time (first time T1) which is longer than the determination time Ts in step S2, the control section 9 executes the first flushing processing of step S3 before the second flushing processing of step S4. On the other hand, when the elapsed time T is determined to be a time (second time T2) which is shorter than the determination time Ts in step S2, the control section 9 executes the second flushing processing of step S4, without performing the first flushing processing of step S3. In the flushing processing, by continuously applying the flushing pulse FP (maintenance drive waveform) which is shown in FIG. 6A and FIG. 6B, to the piezoelectric element 33, a relatively strong pressure variation is given to the ink within the pressure chamber 38, and thereby, the ink from the nozzle 37 is forcibly ejected toward the flushing box 23.

Figure 6A:
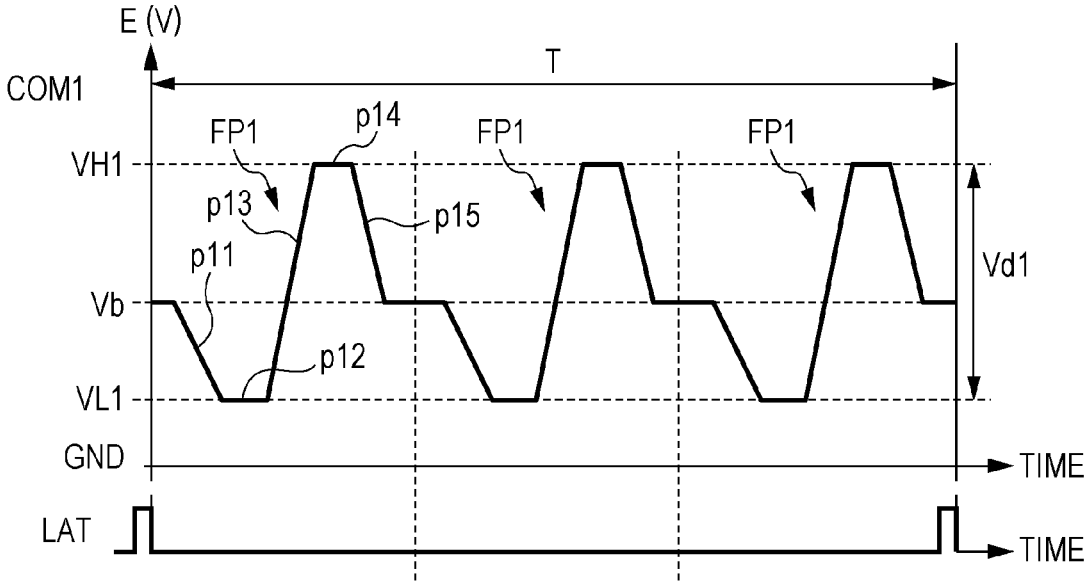
FIG. 6A and FIG. 6B are waveform diagrams describing a configuration of a drive signal which is used in the flushing processing.
Figure 6B:
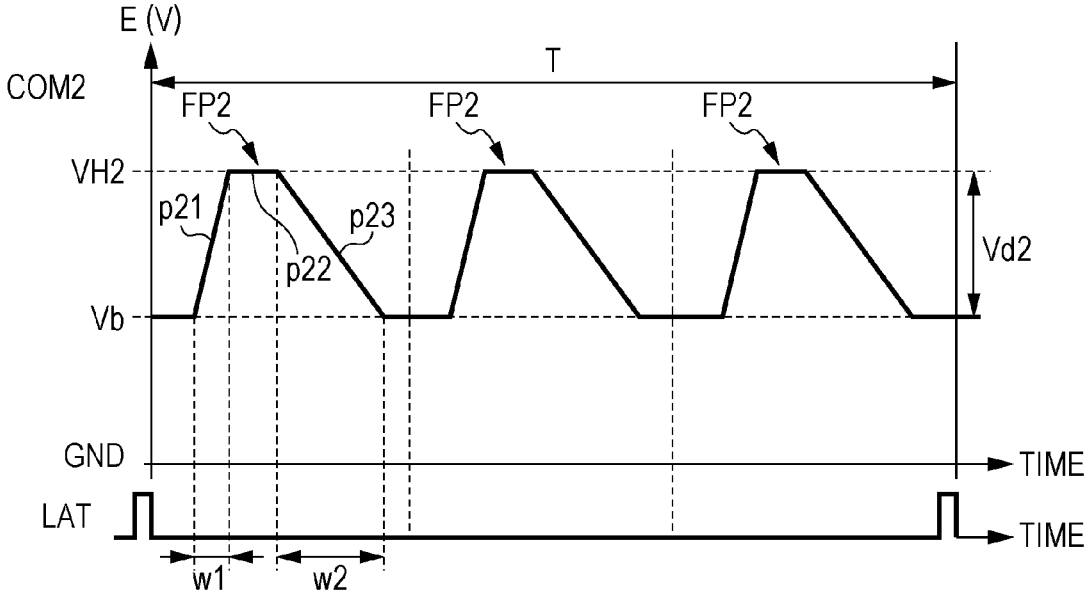

FIG. 6A and FIG. 6B are waveform diagrams describing an example of the drive signal for flushing which is used in the flushing processing. FIG. 6A is a waveform diagram of the first drive signal COM1 (first drive signal) for flushing which is used in the first flushing processing. FIG. 6B is a waveform diagram of the second drive signal COM2 (second drive signal) for flushing which is used in the second flushing processing. The drive signals COM1 and COM2 for flushing, are generated to repeat in a period T (unit period) that is regulated by a timing signal LAT which is generated on the basis of the encoder pulse. In the first drive signal COM1 for flushing of the embodiment, three first flushing pulse FP1 (corresponding to the first drive waveform in the invention) in total are generated within the unit period T. Moreover, in the second drive signal COM2 for flushing, three second flushing pulse FP2 in total are generated within the unit period T. Furthermore, the number of the flushing pulses FP1 and FP2 which are generated in the drive signals COM1 and COM2 for flushing per unit period T, is not limited to the exemplification. Additionally, it is possible to configure so as to appropriately select the flushing pulse by mixing and generating the flushing pulses FP1 and FP2 in one drive signal for flushing.

The first flushing pulse FP1 is a drive pulse which is set so that the pressure variation generated within the pressure chamber 38 at the time of driving the piezoelectric element 33, is relatively large. The first flushing pulse FP1 is made up of a preliminary expansion section p11, a expansion hold section p12, a first contraction section p13, a first contraction hold section p14, and a first return expansion section p15. The preliminary expansion section p11 is a waveform section that changes the potential up to a first expansion potential VL1 from a reference potential Vb, to a ground potential GND side (minus (first potential) side). The state of applying the reference potential Vb to the piezoelectric element 33, is an initial state, and the position of a meniscus within the nozzle 37 in the initial state, corresponds to the standby position of the invention. The meniscus which is in the standby position, is in the state (in other words, the state of being bent in a convex shape to the pressure chamber side) where a center portion is concave to the pressure chamber side by a back pressure on an upstream side of an ink flow channel within the recording head 6. The expansion hold section p12 is a waveform section that holds (for the fixed time) the first expansion potential VL1, which is an end edge potential of the preliminary expansion section p11. The first contraction section p13 is a waveform section that changes the potential up to a first contraction potential VH1 exceeding the reference potential Vb from the first expansion potential VL1, in a relatively steep slope to a plus (second potential) side. A potential difference Vdl up to the first contraction potential VH1 from the first expansion potential VL1, and the slope of a potential change of the first contraction section p13, are set so as to be capable of ejecting the ink from the nozzle 37. The first contraction hold section p14 is a waveform section that holds the first contraction potential VH1 for a predetermined time. The first return expansion section p15 is a waveform section that returns the potential up to the reference potential Vb from the first contraction potential VH1.

If the first flushing pulse FP1 which is configured as described above, is applied to the piezoelectric element 33, first, the piezoelectric element 33 is bent to the outside (side which is separated from the nozzle plate 31) of the pressure chamber 38 by the preliminary expansion section p11, and the pressure chamber 38 expands up to an expansion volume corresponding to the first expansion potential VL1 from a reference volume corresponding to the reference potential Vb, along therewith. By the expansion, the surface (meniscus) of the ink at the nozzle 37 is pulled into the pressure chamber 38 side from the standby position along a nozzle axis direction. Therefore, the expansion state of the pressure chamber 38 is held for the fixed time by the expansion hold section p12. After the hold due to the expansion hold section p12, the piezoelectric element 33 is bent to the inside (side which is close to the nozzle plate 31) of the pressure chamber 38 by the first contraction section p13. Along therewith, the pressure chamber 38 rapidly contracts up to a contraction volume corresponding to the first contraction potential VH1 from the expansion volume. Hereby, the ink within the pressure chamber 38 is pressurized, and the meniscus which is pulled into the pressure chamber 38 side, is pushed out onto the ejecting side which is the opposite side to the pressure chamber 38 side, past the standby position along the nozzle axis direction. Hereby, ink droplets are ejected from the nozzle 37. Subsequently, the first return expansion section p15 is applied, and thereby, the piezoelectric element 33 comes back up to a normal position corresponding to the reference potential Vb. Along therewith, the pressure chamber 38 expands and returns up to the reference volume corresponding to a first middle potential VM1 from the contraction volume. Hereby, the meniscus is pulled into the pressure chamber 38 side, again. Weight per one droplet of the ink which is ejected from the nozzle 37 by the first flushing pulse FP1, is approximately 6 ng.

In the first flushing processing, the first flushing pulse FP1 is applied to the piezoelectric element 33 one or more times, and the ink from the nozzle 37 is made to be shot to the flushing box 23. Due to the first flushing pulse FP1, the ink is ejected from the nozzle 37 by displacing the meniscus onto the pressure chamber 38 side and the ejecting side along the nozzle axis direction while interposing the standby position from the standby position. Furthermore, the meniscus at the standby position within the nozzle 37 is further pulled into the pressure chamber 38 side from the state of being bent to the pressure chamber 38 side, and thereby, the thickened ink in the vicinity of the meniscus is likely to be broken. Moreover, since an amount (stroke amount) of displacing the meniscus along the nozzle axis direction, can be made to be relatively large, the ink is well stirred. That is, with respect to the ink of the nozzle 37 and the pressure chamber 38, since the ink is stirred by sequentially operating a negative pressure by the preliminary expansion section p11, and a positive pressure by the first contraction section p13, the ink can be discharged from the nozzle 37 by particularly softening or breaking the thickened ink in the vicinity of the meniscus at the nozzle 37. For example, when a free running time in which the ink is not ejected in the middle of executing the recording processing (, that is, the elapsed time T) is from the determination time Ts to several minutes, or tens of minutes, in the first flushing processing, the flushing is performed by the first flushing pulse FP1 tens of times. Hereby, in the first flushing processing, the ink of approximately 600 ng from 400 ng, is consumed. For example, when a non-use state where the power source of the printer 1 is not charged, continues for the period which is from several days to several months, the flushing is performed by the first flushing pulse FP1 in the first flushing processing hundreds of times.

Figure 7:
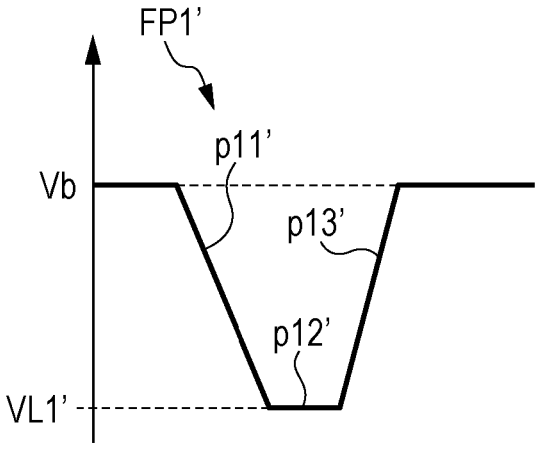
FIG. 7 is a waveform diagram describing a configuration of a modification example of a first flushing pulse.

Furthermore, regarding the first flushing pulse FP1, a so-called pull shooting case is favorable where the ink is ejected from the nozzle 37 by displacing the meniscus at the nozzle 37 onto each of the pressure chamber 38 side and the ejecting side along the nozzle axis direction while interposing the standby position from the standby position, and it is not limited the exemplification in FIG. 6A and FIG. 6B. For example, as a modification example of the first flushing pulse FP1, it is possible to adopt a first flushing pulse FP1' shown in FIG. 7. The first flushing pulse FP1' is made up of a preliminary expansion section p11', an expansion hold section p12', and a first contraction section p13'. The first flushing pulse FP1' is different from the FP1 with the point in which waveform elements corresponding to the first contraction hold section p14 and the first return expansion section p15 of the first flushing pulse FP1, are not included. Since the first flushing pulse FP1' is a drive pulse which is intended so that the pressure variation generated within the pressure chamber 38 at the time of driving the piezoelectric element 33 becomes relatively large, the first flushing pulse FP1' may not necessarily include the first contraction hold section p14 and the first return expansion section p15 relating to vibration control mainly after the ink is ejected. In order to match a pushing amount of the meniscus by the first contraction section p13' of the first flushing pulse FP1', to the pushing amount of the meniscus by the first contraction section p13 of the first flushing pulse FP1 (that is, in order to make the pushing amount which is necessary to eject the ink), a first expansion potential VL1' is set to be lower than the first expansion potential VL1. Hence, the potential difference of the preliminary expansion section p11' becomes larger than the potential difference of the preliminary expansion section p11 of the FP1. Therefore, in the first flushing pulse FP1', a pulling amount of the meniscus by the preliminary expansion section p11', becomes large, and the thickened ink in the vicinity of the meniscus is more likely to be broken. That is, the stirring effect is enhanced more.

After the first flushing processing is executed, the second flushing processing of step S4 is subsequently executed. The second flushing pulse FP2 which is used in the second flushing processing, is a drive pulse that is set so as to suppress the stirring of the ink in comparison with the first flushing pulse FP1. The second flushing pulse FP2 is made up of a second contraction section p21, a second contraction hold section p22, and a second return expansion section p23. The second contraction section p21 is a waveform section that changes the potential up to the second contraction potential VH2 from the reference potential Vb, in the relatively steep slope to the plus side. A potential difference Vd2 up to the second contraction potential VH2 from the reference potential Vb, and the slope of the potential change of the second contraction section p21, are set so as to be capable of ejecting the ink from the nozzle 37. The second contraction hold section p22 is a waveform section that holds the second contraction potential VH2 for the predetermined time. Therefore, the second return expansion section p23 is a waveform section that changes the potential up to the reference potential Vb from the second contraction potential VH2, in a sufficiently gradual slope.

Here, in the second flushing pulse FP2 described above, a time wl which is up to an end edge from a start edge of the second contraction section p21, that is, the time w1 in the case where the second contraction section p21 is applied to the piezoelectric element 33, is set to be relatively short. Specifically, for example, when a Helmholtz vibration period (natural vibration period) of vibration (pressure wave) which is generated into the ink within the pressure chamber 38, is assumed to be Tc, the time w1 is set to be less than Tc (w1<Tc). Hereby, if the piezoelectric element 33 is driven by the second contraction section p21, since the pressure chamber 38 rapidly contracts, it is possible to give a relatively strong pressure change into the ink within the pressure chamber 38. In contrast, a time w2 which is up to the end edge from the start edge of the second return expansion section p23, that is, the time w2 in the case where the second return expansion section p23 is applied to the piezoelectric element 33, becomes sufficiently long in comparison with the time w1. Specifically, the time w2 is set to be Tc or more. Hereby, if the piezoelectric element 33 is driven by the second return expansion section p23, the pressure chamber 38 expands relatively gradually. In other words, it is reduced that the inside pressure of the pressure chamber 38 rapidly becomes negative. Additionally, in the viewpoint of suppressing the rapid pressure change in the pressure chamber 38, the time w2 is preferably long. For example, it is preferable that the period of the meniscus after ejecting the ink from the nozzle 37 which is longer than Tc, is a vibration period Tm or more.

Furthermore, Tc is specifically fixed per recording head, by a shape, a dimension, and rigidity of each configuration member of the nozzle 37, the pressure chamber 38, the ink supply port 43, the piezoelectric element 33 and the like. For example, the specific vibration period Tc can be expressed by the following equation (1).

$$Tc=2\pi\sqrt{[[(Mn\times Ms)/(Mn+Ms)]\times Cc]} \quad (1)$$

However, in the equation (1), Mn is inertance in the nozzle 37, Ms is the inertance in the ink supply port 43, and Cc is compliance (showing a volume change and degrees of softness per unit pressure) of the pressure chamber 38. In the above equation (1), the inertance M shows the easy transfer of the liquid in the flow channel, in other words, mass of the liquid per unit cross-sectional area. Therefore, when the density of the liquid is assumed to be as ρ, the cross-sectional area of the face which is perpendicular to a flow-down direction of the liquid of the flow channel, is assumed to be as S, and a length of the flow channel is assumed to be as L, the inertance M can be expressed by the following equation (2), approximately.

$$M=(\rho\times L)/S \quad (2)$$

Similarly, Tm can be expressed by, for example, the following equation (3).

$$Tm=2\pi\sqrt{(M_{\perp}\times Cm)} \quad (3)$$

However, in the equation (3), $M_{\perp}$=Mn+Ms. Moreover, when Cm is the compliance in the nozzle 37, an opening diameter of the ejecting side of the nozzle 37 is assumed to be as d, and the surface tension of the meniscus is assumed to be as γ, Cm is expressed by the following equation (4).

$$Cm=(\pi\times d^4)/(128\times\gamma) \quad (4)$$

Furthermore, Tc is not limited to the regulation with the above equation (1), and if being the vibration period which is included in the pressure chamber 38 of the recording head 6, it is favorable. Similarly, Tm is not limited to the regulation with the above equation (3), and if being the vibration period of the meniscus at the nozzle 37, it is favorable.

If the second flushing pulse FP2 which is configured as described above, is applied to the piezoelectric element 33, first, the piezoelectric element 33 is bent to the inside (side which is close to the nozzle plate 31) of the pressure chamber 38 by the second contraction section p21. Along therewith, the pressure chamber 38 rapidly contracts up to the contraction volume corresponding to the second contraction potential VH2 from the reference volume corresponding to the reference potential Vb. Hereby, the ink within the pressure chamber 38 is pressurized, and the meniscus which is in the standby position, is rapidly pushed out onto the ejecting side along the nozzle axis direction, and the ink droplets are ejected from the nozzle 37. A contraction state of the pressure chamber 38 is held by the second contraction hold section p22, for the fixed time. After the second contraction hold section p22, subsequently, the second return expansion section p23 is applied, and thereby, the piezoelectric element 33 comes back up to the normal position corresponding to the reference potential Vb. Along therewith, the pressure chamber 38 gradually expands and returns up to the reference volume corresponding to the first middle potential VM1 from the contraction volume. Hereby, the meniscus gradually returns up to the initial position. As described above, in the embodiment, since the time w2 of the second return expansion section p23 is set to be Tc or more, it is suppressed that the meniscus at the nozzle 37 is pulled into the pressure chamber 38 side strongly than necessary. Hereby, it is reduced that the thickened ink in the vicinity of the nozzle 37 is diffused to the pressure chamber 38 side. The weight per one droplet of the ink which is ejected from the nozzle 37 by the second flushing pulse FP2, is generally a value in a range of 2 ng to 30 ng. In this manner, in the second flushing processing, it is possible to discharge the thickened ink in the vicinity of the nozzle 37 while suppressing the stirring of the ink.

As described above, the printer 1 according to the invention, is capable of performing the efficient flushing processing by suppressing wasted consumption of the ink. That is, by previously performing the first flushing processing using the first flushing pulse FP1 in which an ejecting amount per one time is relatively large, it is possible to discharge the thickened ink by softening or breaking the thickened ink in the vicinity of the meniscus at the nozzle 37. Thereafter, by performing the second flushing processing using the second flushing pulse FP2 in which the ejecting amount per one number of times is relatively small, and which is unlikely to stir the ink, it is suppressed that the thickening proceeds to the pressure chamber 38 side, and it is possible to reduce the amount of the ink which is consumed in the entire flushing processing. Moreover, when the elapsed time T is the first time which is longer than the determination time Ts, since the thickening of the meniscus relatively proceeds, by executing the first flushing processing before the second flushing processing, it is possible to more reliably discharge the thickened ink more reliably. On the other hand, when the elapsed time T is the second time which is shorter than the determination time Ts, since the thickening of the meniscus is relatively slight, by executing only the second flushing processing without executing the first flushing processing, unnecessary flushing is reduced. As a result, it is possible to further reduce the amount of the liquid which is consumed in the entire flushing processing. Furthermore, by determining the determination time Ts is depending on the viscosity change properties of the ink, it is possible to set the determination time Ts more appropriately, and it is possible to more reliably reduce the wasted consumption in the ink at the flushing processing. For example, when the flushing processing is performed by only the first flushing pulse FP1, a total consumption amount of the ink is 2400 ng, approximately. On the other hand, when the first flushing processing and the second flushing processing are performed, the total consumption amount of the ink is 1600 ng, approximately. In addition, when only the second flushing processing is performed, the total consumption of the ink can be reduced to 1200 ng, approximately.

Figure 8A:
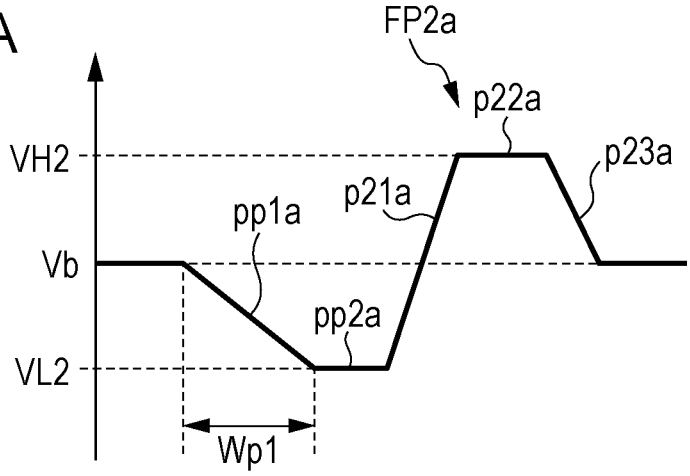
FIG. 8A, FIG. 8B, and FIG. 8C are waveform diagrams describing a configuration of a modification example of a second flushing pulse.

Here, the second flushing pulse FP2 of the embodiment is a drive waveform that starts from the second constriction section p21 (that is, there is no potential change before the second contraction section p21), but if the meniscus does not substantially change (displace) onto the pressure chamber side which is opposite to the ejecting side while interposing the standby position from the standby position, the waveform element that changes the potential before the second contraction section p21, may be included. For example, a second flushing pulse FP2*a* which is a first modification example shown in FIG. 8A, has a preliminary expansion section pp1*a*, and an expansion hold section pp2*a*, before a second contraction section p21*a*. The preliminary expansion section pp1*a* is a waveform section that changes the potential to the minus side up to the second expansion potential VL2 from the reference potential Vb. The slope of the potential change of the preliminary expansion section pp1*a*, is set to be gradual in the degrees where the meniscus which is in the standby position, is not almost displaced. That is, since force for displacing the meniscus onto the pressure chamber 38 side by the preliminary expansion section pp1*a*, is weak, even if the meniscus is slightly displaced onto the pressure chamber 38 side, the meniscus does not move significantly, and thus, since a stirring operation of the meniscus is not substantially generated, the meniscus is not substantially displaced. Therefore, the second flushing pulse FP2*a* is a drive waveform for ejecting the ink from the nozzle 37 by pushing out the meniscus onto the ejecting side, without substantially changing the meniscus onto the pressure chamber 38 side while interposing the standby position from the standby position. Furthermore, other configurations are mostly the same as the second flushing pulse FP2.

Figure 8B:
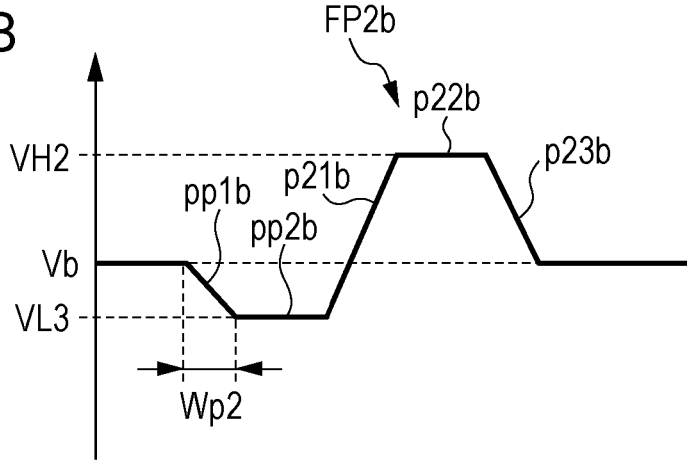

Similarly, a second flushing pulse FP2*b* which is a second modification example shown in FIG. 8B, has a preliminary expansion section pp1*b*, and an expansion hold section pp2*b*, before a second contraction section p21*b*. The preliminary expansion section pp1*b* is a waveform section that changes the potential to the minus side up to a third expansion potential VL3 from the reference potential Vb. The third expansion potential VL3 is set to be a value between the reference potential Vb and the second expansion potential VL2. That is, it is suppressed that the potential difference between the reference potential Vb and the third expansion potential VL3, is relatively low. Hereby, the meniscus is displaced onto the pressure chamber 38 side by the preliminary expansion section pp1*b*, but the meniscus does not move significantly, and thus, since the stirring operation of the meniscus is not substantially generated, the meniscus is not substantially displaced. Therefore, the second flushing pulse FP2*b* is a drive waveform for ejecting the ink from the nozzle 37 by pushing out the meniscus onto the ejecting side, without substantially displacing the meniscus onto the pressure chamber 38 side while interposing the standby position from the standby position. Additionally, other configurations are mostly the same as the second flushing pulse FP2*a*.

Figure 8C:
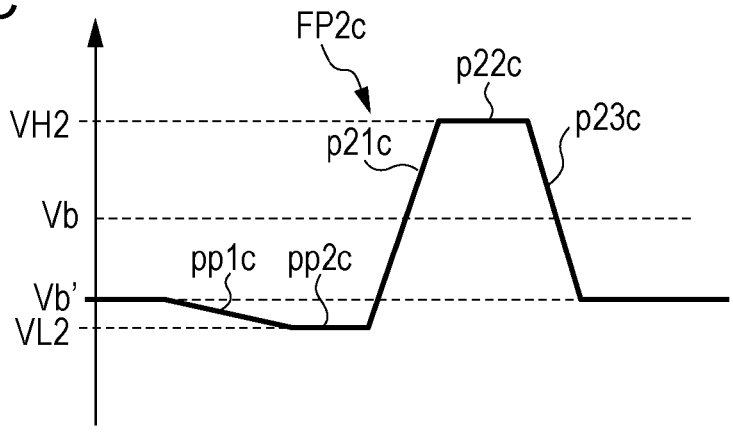

Furthermore, a second flushing pulse FP2*c* which is a third modification example shown in FIG. 8C, is a drive waveform whose the reference potential is set to be Vb' which is lower than the reference potential Vb of the second flushing pulse FP2*a*. The second flushing pulse FP2*c* has a preliminary expansion section pp1*c* that changes the potential to the minus side up to the second expansion potential VL2 from the second reference potential Vb', and an expansion hold section pp2*c* that holds the second expansion potential VL2 for the predetermined time. In this manner, by lowering the reference potential, a potential change ratio of the preliminary expansion section pp1*c* becomes gradual, and it is suppressed that the potential difference between the second reference potential Vb' and the second expansion potential VL2, is low. Hereby, the meniscus is displaced onto the pressure chamber 38 side by the preliminary expansion section pp1*c*, but the meniscus does not move significantly, and thus, since the stirring operation of the meniscus is not substantially generated, the meniscus is not substantially displaced. Therefore, the second flushing pulse FP2*c* is a drive waveform for ejecting the ink from the nozzle 37 by pushing out the meniscus onto the ejecting side, without substantially displacing the meniscus onto the pressure chamber 38 side while interposing the standby position from the standby position. Furthermore, other configurations are mostly the same as the second flushing pulse FP2*a*.

According to the second flashing pulses of the modification examples, without substantially displacing the meniscus onto the pressure chamber 38 side from the standby position before the second contraction section, the degree of freedom in setting a voltage of the second contraction section, is improved. That is, it is possible to earn the stroke of the meniscus at the time of ejecting the ink from the nozzle 37 by the second contraction section, while suppressing the stirring.

In the above embodiments, as a pressure generation unit, the piezoelectric element 33 of a so-call bent vibration type, is exemplified, but it is not limited thereto. For example, it is also possible to adopt a piezoelectric element of a so-called longitudinal vibration type. In this case, the drive pulses FP1 and FP2 which are exemplified in the above embodiments, are drive waveforms in which the change direction of the potential, that is, top and bottom is reversed.

Moreover, as a pressure generation unit, it is not limited to the piezoelectric element, and it is possible to apply the invention even in the case of using various kinds of pressure generation units such as an electrostatic actuator that changes the volume of the pressure chamber using electrostatic force.

Therefore, if being a liquid ejecting apparatus that performs the flushing processing for discharging the thickened liquid from the nozzle, the invention is not limited to the printer described above, and can be applied to various kinds of ink jet recording apparatuses such as a plotter, a facsimile apparatus, and a copy machine, or a textile printing apparatus that performs textile printing by landing the ink from the liquid ejecting head with respect to fabric (printed material) which is a kind of the landing target, or the liquid ejecting apparatus in addition to the recording apparatus, for example, a display manufacturing apparatus, an electrode manufacturing apparatus, or a chip manufacturing apparatus.

What is claimed is:

1. A liquid ejecting apparatus comprising:

a liquid ejecting head that has a pressure chamber to communicate with a nozzle, and a pressure generation unit to generate a pressure variation to liquid within the pressure chamber, and is configured to eject the liquid from the nozzle by an operation of the pressure generation unit, wherein the apparatus is configured to perform a flushing processing by driving the pressure generation unit by a first drive waveform, and a second drive waveform which is different from the first drive waveform, the first drive waveform is a drive waveform for ejecting the liquid from the nozzle by displacing a meniscus at the nozzle from a standby position, along a nozzle axis direction, from the pressure chamber side to an ejecting side which is opposite to the pressure chamber side while passing the standby position, the second drive waveform is a drive waveform for ejecting the liquid from the nozzle by pushing out the meniscus onto the ejecting side from the standby position, without substantially displacing the meniscus at the nozzle onto the pressure chamber side from the standby position, and in the flushing processing, a first flushing processing is selectively performed by applying the first drive waveform one or more times with respect to the pressure generation unit and a second flushing processing is selectively performed by applying the second drive waveform a plurality of times with respect to the pressure generation unit, wherein depending on an elapsed time from a time of finally ejecting the liquid to a determination time Ts, the apparatus is configured to select whether or not to perform the first flushing processing before the second flushing processing.

2. The liquid ejecting apparatus according to claim 1, wherein when the elapsed time is a first time which is longer than the determination time Ts to be determined in advance, the first flushing processing is executed before the second flushing processing, and when the elapsed time is a second time which is shorter than the determination time Ts, only the second flushing processing is executed without executing the first flushing processing.

3. The liquid ejecting apparatus according to claim 2, wherein the determination time Ts is determined depending on viscosity change properties of the liquid.

4. A method for controlling a liquid ejecting apparatus including a liquid ejecting head that has a pressure chamber to communicate with a nozzle, and a pressure generation unit to generate a pressure variation to liquid within the pressure chamber, and is configured to eject the liquid from the nozzle by an operation of the pressure generation unit, the method comprising:

performing a flushing processing by driving the pressure generation unit by a first drive waveform, and a second drive waveform which is different from the first drive waveform, wherein the first drive waveform is a drive waveform for ejecting the liquid from the nozzle by displacing a meniscus at the nozzle from a standby position, along a nozzle axis direction, onto the pressure chamber side and an ejecting side which is opposite to the pressure chamber side while passing the standby position, the second drive waveform is a drive waveform for ejecting the liquid from the nozzle by pushing out the meniscus onto the ejecting side, without substantially displacing the meniscus at the nozzle onto the pressure chamber side from the standby position, and in the flushing processing, after a first flushing processing is performed by applying the first drive waveform one or more times with respect to the pressure generation unit, a second flushing processing is performed by applying the second drive waveform a plurality of times with respect to the pressure generation unit.

* * * * *